US008025358B2

(12) United States Patent
Umeda

(10) Patent No.: US 8,025,358 B2
(45) Date of Patent: Sep. 27, 2011

(54) RECORDING HEAD PROTECTIVE CAP, INKJET RECORDING APPARATUS USING THE SAME, AND METHOD OF PRODUCING THE SAME

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 669 days.

(21) Appl. No.: 11/474,446

(22) Filed: Jun. 26, 2006

(65) Prior Publication Data

US 2007/0002093 A1 Jan. 4, 2007

(30) Foreign Application Priority Data

Jun. 30, 2005 (JP) ..... 2005-191953

(51) Int. Cl.
*B41J 2/165* (2006.01)

(52) U.S. Cl. ..... 347/29

(58) Field of Classification Search ..... 347/87, 347/33, 29; 264/266, 250; 215/341; 428/447; 156/228
See application file for complete search history.

(56) References Cited

U.S. PATENT DOCUMENTS

| | | | | |
|---|---|---|---|---|
| 4,036,388 | A * | 7/1977 | Davidson | 215/341 |
| 4,554,125 | A * | 11/1985 | Knapp | 264/266 |
| 5,226,997 | A * | 7/1993 | Vallier | 156/228 |
| 5,444,474 | A * | 8/1995 | Ohtsubo et al. | 347/87 |
| 5,484,566 | A * | 1/1996 | Gabbard | 264/250 |
| 5,645,941 | A * | 7/1997 | Meguriya et al. | 428/447 |
| 6,402,291 | B1 * | 6/2002 | Millman et al. | 347/33 |
| 6,471,330 | B1 | 10/2002 | Umeda et al. | |
| 6,517,185 | B1 * | 2/2003 | Aldrich | 347/29 |
| 7,690,757 | B2 * | 4/2010 | Kusunoki et al. | 347/29 |

FOREIGN PATENT DOCUMENTS

| | | | |
|---|---|---|---|
| JP | 2001-080086 | A | 3/2001 |
| JP | 2001 80091 | | 3/2001 |
| JP | 2001-080091 | A | 3/2001 |
| JP | 2001080086 | * | 3/2001 |
| JP | 2003-340766 | A | 12/2003 |
| JP | 2003340766 | * | 12/2003 |
| JP | 2005-161803 | A | 6/2005 |

OTHER PUBLICATIONS

Japan Patent Office, Notification of Reason for Refusal for Japanese Patent Application No. 2005-191953 (counterpart to above-captioned patent application), mailed Oct. 5, 2010.

* cited by examiner

*Primary Examiner* — Stephen Meier
*Assistant Examiner* — Carlos A Martinez
(74) *Attorney, Agent, or Firm* — Baker Botts L.L.P.

(57) ABSTRACT

A protective cap for an inkjet recording apparatus includes a recording head having an ejection surface in which open ends of nozzles are arranged in a row. The cap includes a mainbody and an elastic lip portion. The mainbody is formed of a first material mainly composed of thermoplastic elastomer and containing butyl rubber. The first material has a hardness of a first degree. The mainbody includes a base portion, and a protruding portion formed integrally with the base portion to protrude from the base portion. The lip portion is formed of a second material mainly composed of thermoplastic elastomer and containing butyl rubber. The second material has a hardness of a second degree lower than the first degree. The lip portion is disposed on at least the protruding portion to cover at least an end portion of the protruding portion.

12 Claims, 5 Drawing Sheets

CROSS-SECTIONAL VIEW TAKEN PERPENDICULALY TO LONGITUDIONAL DIRECTION OF PROTECTIVE CAP

CROSS-SECTIONAL VIEW TAKEN ALONG LONGITUDIONAL DIRECTION OF PROTECTIVE CAP

INTEGRALLY FORMING MAINBODY AND CAP HOLDER

REMOVING UPPER MOLD 201'

SETTING ANOTHER UPPER MOLD 203'→FORMING LIP PORTION

COMPLETE

RECORDING HEAD PROTECTIVE CAP, INKJET RECORDING APPARATUS USING THE SAME, AND METHOD OF PRODUCING THE SAME

INCORPORATION BY REFERENCE

The present application is based on Japanese Patent Application No. 2005-191953, filed on Jun. 30, 2005, the contents of which are incorporated herein by reference.

BACKGROUND OF THE INVENTION

1. Field of the Invention

The present invention relates to a protective cap for covering a row of nozzles open in an ejection surface of a recording head, such that a closed or sealed space is defined inside the protective cap. The invention also relates to an inkjet recording apparatus including the protective cap, and a method of producing the protective cap.

2. Description of Related Art

There is known an inkjet recording apparatus including a recording head and a protective cap. The recording head has an ejection surface in which open ends of a plurality of nozzles are arranged in a row. Droplets of ink supplied from a sub tank are selectively ejected from the row of nozzles to record an image on a recording medium. The protective cap is brought into contact with the ejection surface to hermetically cover the nozzle row.

As such a protective cap, there is used a type as disclosed in FIG. 4 of JP-A-2001-80091, which includes a mainbody and a lip portion that are integrally formed of rubber. The mainbody has a protruding portion configured to have a recess inside thereof, and the lip portion is disposed around the recess. When the protective cap covers the nozzle row, the lip portion directly and closely contacts the ejection surface, and a sealed space is defined inside the protruding portion.

The hardness of the rubber forming the mainbody and the lip portion is set at 30-40 Hs JIS A. Throughout this specification and in the appended claims, hardness is defined in accordance with JIS (Japanese Industrial Standards) K 6301. This value is appropriate for preventing occurrence of a clearance between the ejection surface and the lip portion, and deformation of the protruding portion at the same time. That is, when the hardness of the lip portion is too high, the clearance tends to occur. On the other hand, when the hardness of the lip portion is too low, the protruding portion tends to collapse or deform.

Since the mainbody and the lip portion of the protective cap are integrally formed of rubber, when a sucking operation to eliminate or prevent clogging of the nozzles is implemented, a negative pressure is produced in the recess or at the sealed space to cause the lip portion to deform or collapse, thereby closing open ends of the nozzles.

In view of this, there has been proposed a protective cap where a mainbody is formed of synthetic resin and a lip portion is formed of rubber, as disclosed in FIG. 3 of the above-mentioned publication, for instance. The mainbody includes a base portion and a protruding portion extending from the base portion and integrally formed with the base portion. The lip portion is disposed on the protruding portion of the mainbody to cover at least an upper portion of the protruding portion. According to this protective cap, the lip portion of the protective cap does not deform or collapse during the sucking operation, and thus the hermeticity of the sealed space is ensured more stably and reliably.

However, the conventional protective cap is disadvantageous in that the mainbody and the lip portion tend to separate from each other at the interface thereof, since the mainbody and the lip portion are formed of different materials, namely, the mainbody is formed of synthetic resin and the lip portion is formed of rubber.

This disadvantage can be overcome by forming the protruding portion and the lip portion such that the protruding portion has a boss or a hole that engage with a part of the lip portion when the mainbody and the lip portion are assembled. However, this undesirably leads to a complex shape of a mold that is used to form the mainbody.

Further, such a protective cap requires a large number of production steps and pushes up the cost, for the following reasons. That is, since the mainbody and the lip portion are formed of different materials, two molds for forming the mainbody and the lip portion, respectively, should be prepared, accordingly increasing the production cost. More specifically, the protective cap is produced such that the mainbody is formed by injecting a resin material into a mold prepared specially for forming the mainbody, then the thus formed mainbody of resin is taken off the mold and put into another mold prepared specially for forming the lip portion, to form the lip portion by injecting a rubber material into the latter mold. In this way, two production steps are required for producing the protective cap, increasing the number of production steps and accordingly the production cost.

SUMMARY OF THE INVENTION

This invention has been developed in view of the above-described situations, and it is a first object of the invention to provide a robust protective cap including a lip portion that is prevented from deforming or collapsing during the sucking operation so that a hermeticity between an ejection surface of a recording head and the lip portion is ensured more stably and reliably. A second object of the invention is to provide an inkjet recording apparatus including such a protective cap. A third object of the invention is to provide a method of producing such a protective cap with a smaller number of production steps and at a lower cost.

To attain the first object, the invention provides a protective cap for an inkjet recording apparatus including a recording head having an ejection surface in which open ends of a plurality of nozzles are arranged in a row. The protective cap is adapted to cover the row of the open ends of the nozzles such that a sealed space is formed inside the protective cap, and includes a mainbody and an elastic lip portion. The mainbody is formed of a first material mainly composed of thermoplastic elastomer and containing butyl rubber, and the first material has a hardness of a first degree. The mainbody includes a base portion, and a protruding portion formed integrally with the base portion to protrude from the base portion. The elastic lip portion is formed of a second material mainly composed of thermoplastic elastomer and containing butyl rubber, and the second material has a hardness of a second degree which is lower than the first degree. The lip portion is disposed on at least the protruding portion to cover at least an end portion of the protruding portion.

According to the protective cap, the mainbody, which includes the base portion and the protruding portion integrally formed with the base portion and protruding from the base portion, is formed of the first material mainly composed of thermoplastic elastomer and containing butyl rubber. The hardness of the first material is a first degree. On the other hand, the lip portion is disposed at least on the mainbody to cover at least an end portion of the protruding portion, and is formed of the second material mainly composed of thermoplastic elastomer and containing butyl rubber. The hardness of the second material is a second degree that is lower than the first degree. Thus, the hardness of the mainbody is made relatively high to prevent the protective cap from deforming or collapsing during a sucking operation. Further, the hardness of the lip portion is relatively low, that is, the lip portion has an elasticity to achieve a more stable and reliable hermeticity of a space defined between the protective cap and the ejection surface of the recording head.

To attain the second object, the invention also provides an inkjet recording apparatus including the protective cap, and a cap holder formed integrally with the protective cap to support the protective cap, with a material mainly composed of thermoplastic elastomer and containing butyl rubber.

According to this inkjet recording apparatus, the protective cap and the cap holder can be manufactured with a reduced number of production steps and at a lower cost. Further, the number of components of the inkjet recording apparatus as well as the number of assembly steps of the inkjet recording apparatus can be reduced, by the elimination of a step of assembling the protective cap to the cap holder.

To attain the third object, the invention also provides a method of producing a protective cap including a mainbody having a protruding portion and a lip portion covering at least an end portion of the protruding portion. The method includes the steps of: preparing a first mold, a second mold and a third mold; injecting a first material into a space defined between the first mold and the second mold, to form the mainbody; and injecting a second material into a space defined between the third mold and the formed mainbody supported by the first mold, to form the lip portion such that the lip portion covers the at least the end portion of the protruding portion.

According to this method, a mold half used in a first step for forming the mainbody of the protective cap, and a mold half used in a second step for forming the lip portion can be the same, namely, the first mold can serve as a common mold half that is used in both of the first and second steps. Thus, to form the lip portion after the mainbody is formed, it is not necessary to take the mainbody off the first mold as a common mold half, but it is only necessary to replace the second mold with another mold, i.e., the third mold. Hence, the protective cap can be produced with a reduced number of production steps and at a lower cost. Further, a protective cap for an inkjet recording apparatus which is highly robust or unbreakable, free from deformation or collapse of the lip portion during a sucking operation, and capable of more stably and reliably establishing hermeticity can be produced.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which:

FIGS. 4A-4D illustrate a production process of the protective cap, in which FIG. 4A shows a step of forming a harder portion of the protective cap, FIG. 4B shows a step of removing an upper mold, FIG. 4C shows a step of forming a softer portion of the protective cap, and FIG. 4D is a cross-sectional view of the protective cap as finished.

DETAILED DESCRIPTION OF PREFERRED EMBODIMENTS

Hereinafter, there will be described an inkjet recording apparatus to which the invention is applied, by referring to the accompanying drawings.

Figure 1:
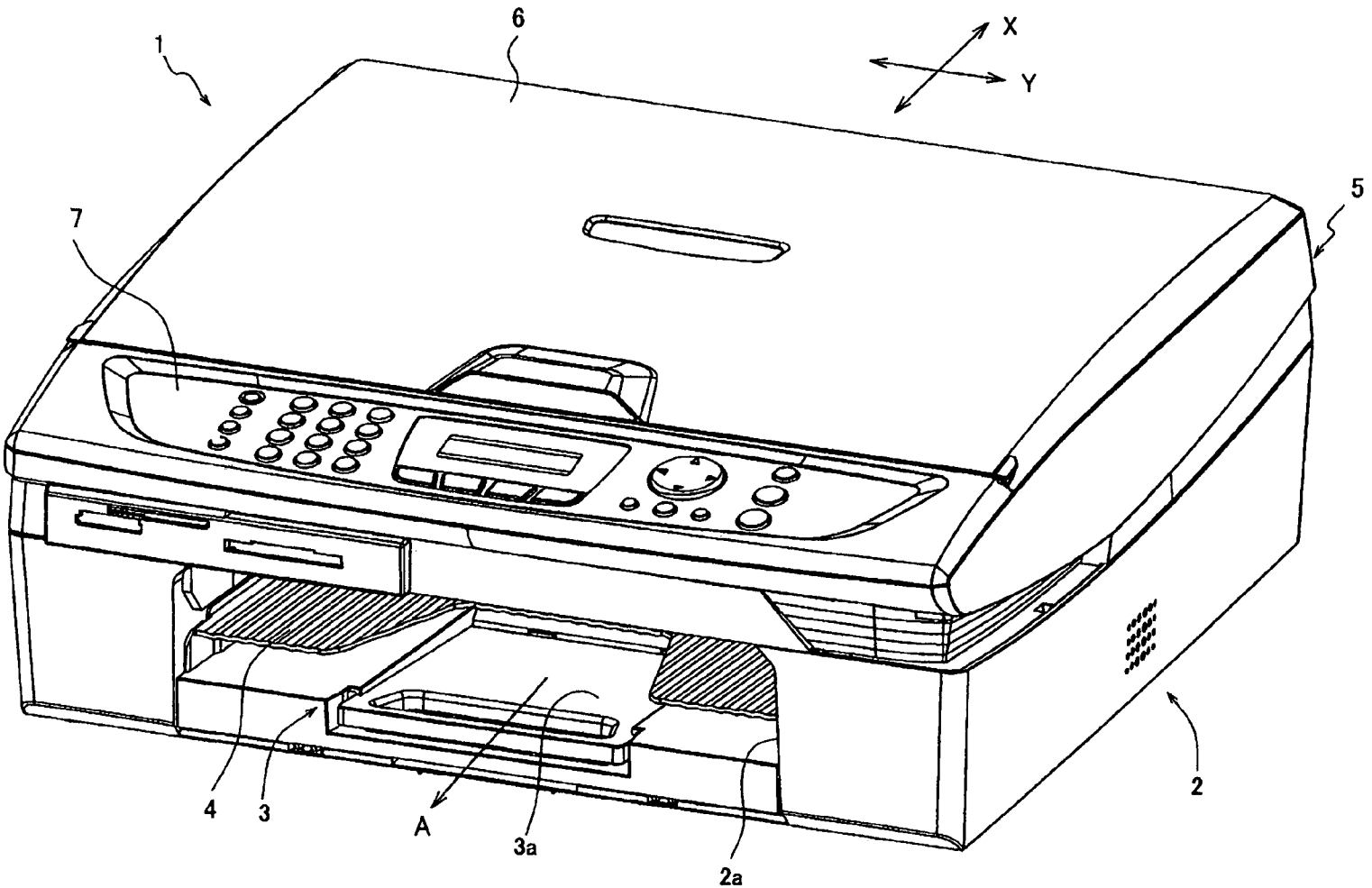
FIG. 1 is an external perspective view of an inkjet recording apparatus to which an embodiment of the invention is applied.

FIG. 1 is an external perspective view of the inkjet recording apparatus that is generally denoted by reference numeral 1.

As shown in FIG. 1, the inkjet recording apparatus 1 is a so-called multifunction device (MFD) having at least two functions such as a printer function, a copier function, a scanner function, and a facsimile function. As a recording medium on which the inkjet recording apparatus 1 records an image, a sheet material such as a paper sheet or a plastic film is used.

The inkjet recording apparatus 1 includes a housing 2 of resin, into a bottom portion of which a medium supply cassette 3 can be inserted from an opening 2*a* formed at a front side of the housing 2. An ejecting portion 4 to which a recording medium on which an image has been recorded is ejected in a direction indicated by arrow A is formed over the medium supply cassette 3. An ejecting opening in communication with the ejecting portion 4 is formed on an upper side of the opening 2*a* at the front side of the housing 2.

The medium supply cassette 3 is capable of accommodating a plurality of recording media, that are for instance in A4 size, letter size, legal size, or post-card size. The recording media are set in the medium supply cassette 3 with longer sides thereof parallel to a medium feeding direction, i.e., an auxiliary scanning direction or an X-axis direction. At a front end of the medium supply cassette 3, an auxiliary support member 3*a* is disposed to be extendable in the X-axis direction in order to support a rear end portion of a relatively long recording medium such as a recording medium in the legal size. When the used recording media are in a size capable of being accommodated in the medium supply cassette 3, e.g., when the used recording media are in the A4 size, the auxiliary support member 3*a* can be housed in a front portion of the medium supply cassette 3 in order not to disturb supply of the recording media.

In an upper portion of the housing 2, there is disposed an image reading unit 5 that is used when a document is read while the copier function or the facsimile function of the apparatus 1 is active. At a side of the apparatus 1, there is a pivot portion (not shown) where the image reading unit 5 is attached to an end portion of the housing 2 to be turnable upward and downward around an axis so that the image reading unit 5 is openable/closable relative to the housing 2. Further, a document cover 6 is disposed over the image reading unit 5 to cover an upper side of the image reading unit 5. The document cover 6 is turnable upward and downward around an axis (not shown) disposed at a rear end of the image reading unit 5.

When an image on a surface of a document is to be read, the document cover 6 is opened or turned upward, and the document is placed on a platen glass. A close-contact type image sensor or CIS (Contact Image Sensor) is disposed under the platen glass to be reciprocable in a Y-axis direction (i.e., a main scanning direction) relative to the surface of the document to scan the image thereon.

At the front side of the document cover 6 disposed over the image reading unit 5, there is disposed an operator panel 7 in which various manual operation buttons and a liquid crystal display are arranged.

An inkjet recording head 10 (shown in FIG. 2) for realizing the printer function is incorporated in the housing 2. That is, in the housing 2, there is disposed a recording unit (not shown) that includes the recording head 10, a carriage (not shown), and other mechanisms. The recording unit is reciprocable in the Y-axis direction or the main scanning direction.

Figure 2:
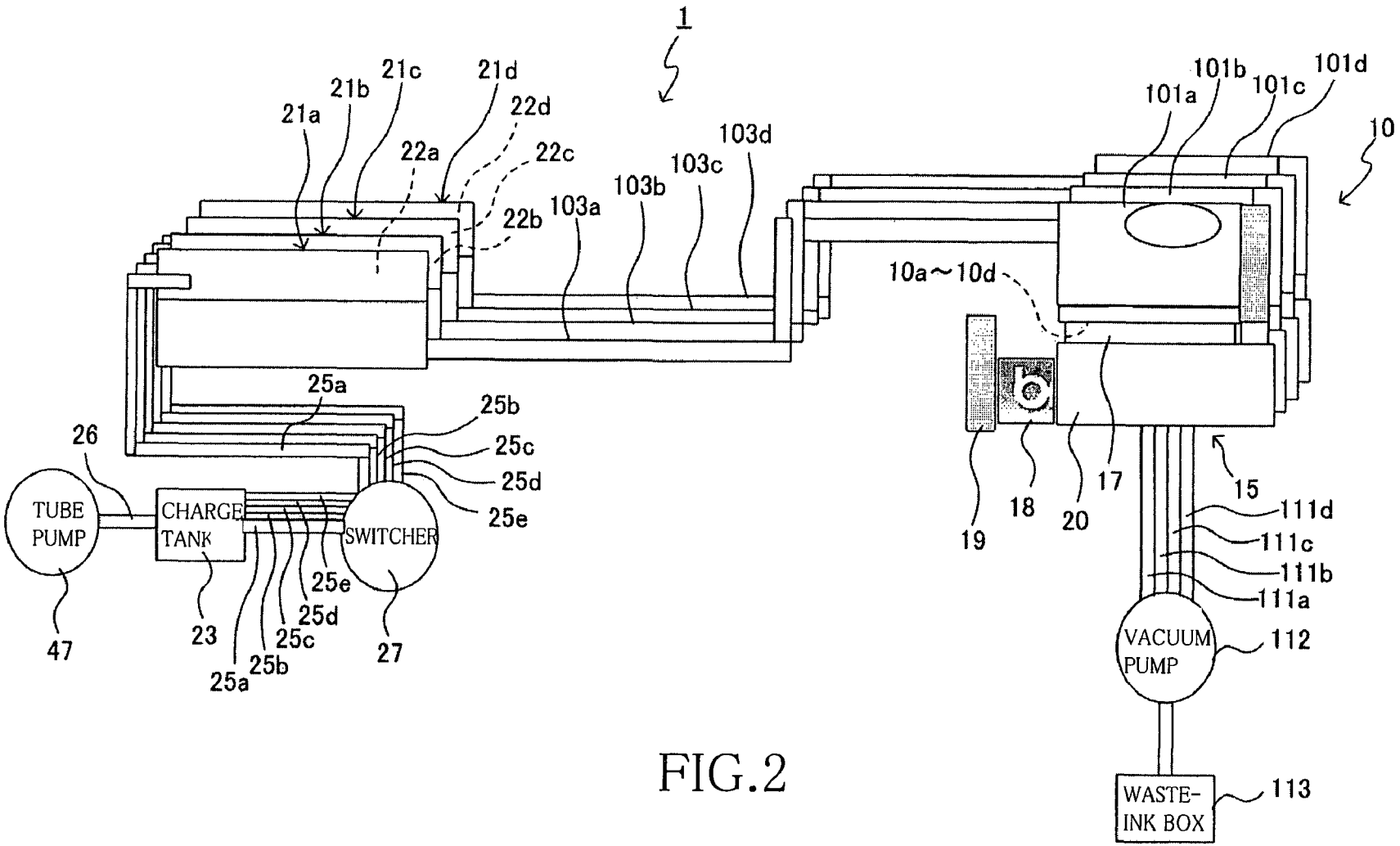
FIG. 2 is a diagram illustrating a principal portion of the inkjet recording apparatus.

FIG. 2 is a block diagram showing a principal portion of the inkjet recording apparatus 1.

As shown in FIG. 2, four nozzle rows 10*a*-10*d* for respective colors, i.e., black, cyan, yellow and magenta, are formed in the recording head 10. Each nozzle in each nozzle row opens downward. A color image is recordable on a recording medium by downward ejecting inks of the four colors from the rows 10*a*-10*d* of nozzles.

The recording head 10 incorporates sub tanks 10l*a*-10*d* for storing the four color inks, respectively, which are supplied from ink cartridges 21*a*-21*d* described below. Each of the sub tanks 101*a*-101*d* is connected to one of the nozzle rows 10*a*-10*d* that is for the same color ink, via a supply passage (not shown), so that the four color inks can be supplied from the sub tanks 101*a*-101*d* to the respectively corresponding nozzle rows 10*a*-10*d*.

Each of the sub tanks 101*a*-101*d* is connected to one of the ink cartridges 21*a*-21*d* that is for the same color ink, via a tube 103*a*-103*d*, so that the four color inks can be supplied from the ink cartridges 21*a*-21*d* to the respectively corresponding sub tanks 101*a*-101*d*. The tubes 103*a*-103*d* can be referred to as ink supply passages.

In the thus constructed recording unit, the carriage is reciprocated in the Y-axis direction or the main scanning direction under control by a carriage control portion (not shown) constituted by a CPU and others, in order to reciprocate the recording head 10. The recording head 10 performs recording on the recording medium, by selectively ejecting, from the rows 10*a*-10*d* of nozzles, droplets of the inks as supplied from the sub tanks 101*a*-101*d* while the carriage is reciprocated.

In the recording unit, a maintenance unit 15 is disposed at a position corresponding to a standby position of the carriage. The maintenance unit 15 can cover the nozzle rows 10*a*-10*d* arranged in an ejection surface of the recording head 10, and includes a protective cap 17 capable of forming a sealed space inside thereof, a cleaning blade 18, a wiper 19, a waste-ink receiver (not shown), a foamed material (not shown) for absorbing waste ink, and a cap holder 20 supporting the protective cap 17. The maintenance unit 15 implements various kinds of maintenance operations, such as a cleaning operation, namely, cleaning the open ends of the nozzles 10*a*-10*d* in the recording head 10 with the cleaning blade 18, a wiping operation that is wiping the ejection surface of the recording head 10 to wipe off with the wiper 19 the inks and others around the rows 10*a*-10*d* of nozzles, a purging operation that is implemented such that when the rows 10*a*-10*d* of nozzles are closed with the protective cap 17 as elevated, and dust, air and solidified ink are forcibly eliminated from the inside of the nozzles 10*a*-10*d*, and a flushing operation that is discharging the inks from the nozzles 10*a*-10*d* into the waste-ink receiver.

The ink cartridges 21*a*-21*d* that store the inks of respective colors, namely, black (K), cyan (C), magenta (M) and yellow (Y), are disposed in the housing 2, for enabling color recording. The ink cartridges 21*a*-21*d* are arranged in a line along the direction of the reciprocation of the carriage, and detachably attached to the housing 2 from the upper side. When any of the inks is to be replenished, the corresponding ink cartridge 21*a*-21*d* is replaced in whole. Each of the ink cartridges 21*a*-21*d* has an air communicating portion 22*a*-22*d* allowing communication between the inside thereof and the atmospheric air. The ink cartridges 21*a*-21*d* serve as main tanks.

The ink cartridges 21*a*-21*d* are connected to a charge tank 23 with respective tubes 25*a*-25*d*, so that the air accumulated in the charge tank 23 can be supplied to the ink cartridges 21*a*-21*d*. Further, the air communicating portions 22*a*-22*d* of the ink cartridges 21*a*-21*d* are connected to the charge tank 23 via another tube 25*e*. More specifically, the tube 25*e* is four-forked at a middle thereof, and the four forked ends are respectively connected to the air communicating portions 22*a*-22*d* of the ink cartridges 21*a*-21*d* and the non-forked end of the tube 25*e* is connected to the charge tank 23, thereby connecting the air communicating portions 22*a*-22*d* to the charge tank 23 via the tube 25e. Thus, the air accumulated in the charge tank 23 can be supplied to the air communicating portions 22*a*-22*d* of the ink cartridges 21*a*-21*d*. However, neither the forked portion of the tube 25*e* nor the connection between the air communicating portions 22*a*-22*d* and the forked ends of the tube 25*e* are shown in FIG. 2. Inside a switcher 27, all of the tubes 25*a*-25*d* and the non-forked portion of the tube 25*e* are disposed parallel to one another. The switcher 27 is a known one and description thereof is omitted.

A tube pump 47 is connected to the charge tank 23 via a tube 26. The charge tank 23 temporarily stores air supplied from the tube pump 47 under control by a control portion (not shown), thereby applying a pressure of a constant level to the ink cartridges 21*a*-21*d*.

The charge tank 23 and the tube pump 47 thus cooperate to apply a pressure to the inks in the ink cartridges 21*a*-21*d* to supply the inks in the ink cartridges 21*a*-21*d* to the sub tanks 101*a*-101*d*.

Figure 3B:
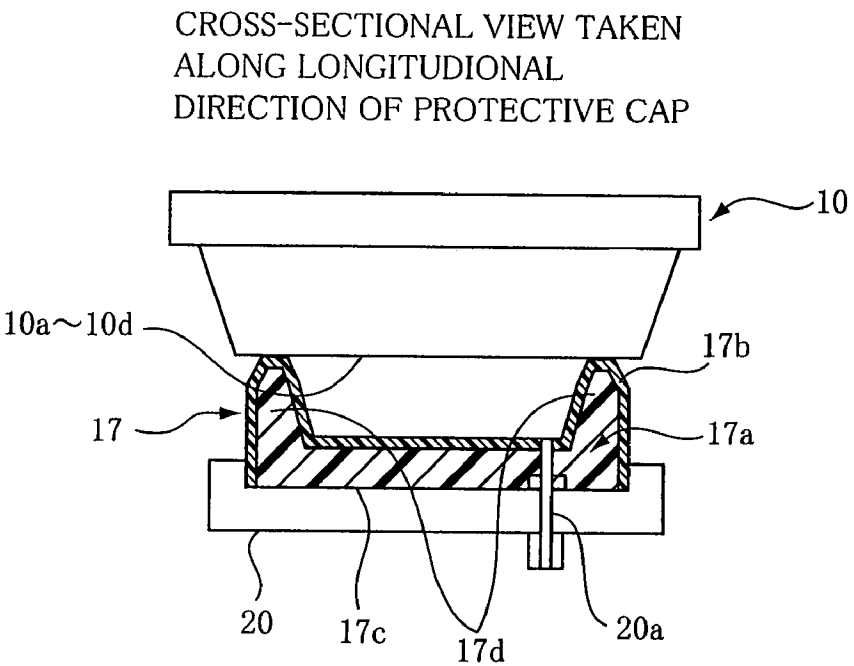
FIGS. 3A and 3B are cross-sectional views of the protective cap taken perpendicularly to and along a longitudinal direction of the protective cap, respectively.

The cap holder 20 of the maintenance unit 15 has communication nozzles 20*a*-20*d* for allowing communication between the exterior and the sealed space defined between the recording head 10 and the protective cap 17. The communication nozzles 20*a*-20*d* of the cap holder 20 are not shown in FIG. 2, but FIG. 3B shows one 20*a* of the communication nozzles 20*a*-20*d*. The communication nozzles 20*a*-20*d* are connected to a vacuum pump 112 via tubes 111*a*-111*d*. When a sucking operation is implemented, the vacuum pump 112 sucks air and ink from the sealed space defined between the recording head 10 and the protective cap 17, by applying a negative pressure. To the vacuum pump 112, a waste-ink box 113 for storing the sucked ink is connected.

That is, while the protective cap 17 of the maintenance unit 15 covers the nozzle rows 10*a*-10*d* of the recording head 10, the vacuum pump 112 is operated under control by the control portion (not shown) to apply the negative pressure so as to suck the ink and bubbles from the nozzles of the rows 10*a*-10*d*, via the protective cap 17, the communication nozzles 20*a*-20*d* of the cap holder 20, and the tubes 111*a*-111*d*. The sucked ink and bubbles are directed to the waste-ink box 113.

Figure 3A:
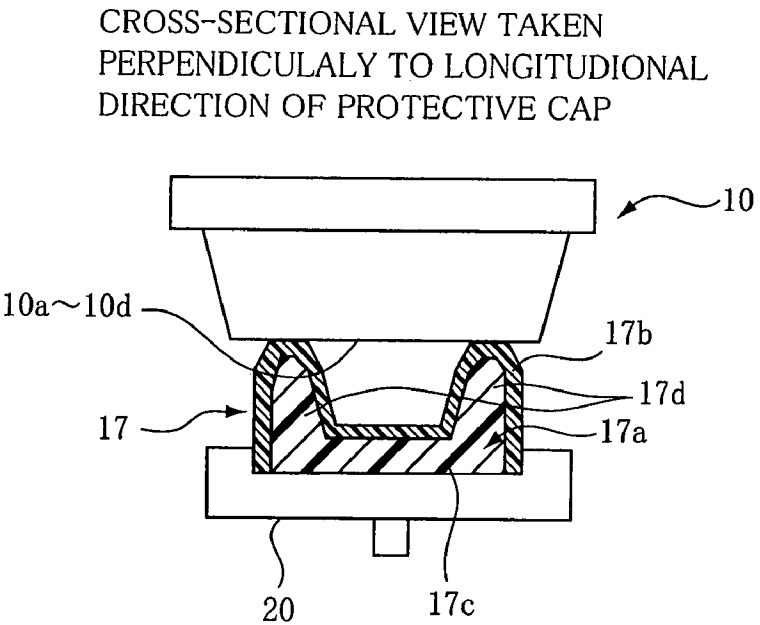

There will be described a structure of the protective cap 17, with reference to FIGS. 3A and 3B, in which FIG. 3A is a cross-sectional view of the protective cap taken perpendicularly to a longitudinal direction thereof, and FIG. 3B is a cross-sectional view taken along the longitudinal direction.

As shown in FIGS. 3A and 3B, the protective cap 17 includes a mainbody 17*a* and a lip portion 17*b*.

The mainbody 17*a* has a recess at a center thereof. When the protective cap 17 is in contact with the ejection surface of the recording head 10, the sealed space is formed inside the recess. More specifically, the mainbody 17*a* has a base portion 17*c* and a protruding portion 17*d* integrally formed with the base portion 17*c* and protruding from the base portion 17*c*. The mainbody 17*a* is formed of a first material mainly composed of thermoplastic elastomer and containing butyl rubber. The first material has a hardness of a first degree. The thermoplastic elastomer may contain polypropylene or polyethylene. In this specific example, the first material contains at least 20% butyl rubber, and the first degree is 60 Hs JIS A or higher.

On the other hand, the lip portion 17b is disposed on the mainbody 17*a* to cover at least an upper portion of the protruding portion 17*d*. The lip portion 17*b* is formed of a second material mainly composed of thermoplastic elastomer and containing butyl rubber, and the thermoplastic elastomer may contain polypropylene or polyethylene. The second material has a hardness of a second degree. In this specific example, the second material contains at least 20% butyl rubber, and the second degree is 40 Hs JIS A or lower. That is, the lip portion 17*b* has an elasticity.

There will be now described a process of producing the protective cap 17, with reference to FIGS. 4A-4D.

Both of the materials respectively forming the mainbody 17*a* and the lip portion 17*b* of the protective cap 17 are mainly composed of thermoplastic elastomer and contains butyl rubber. However, the materials differ from each other in hardness. The materials are in order injected into a same lower mold to first form the mainbody 17*a* and then the lip portion 17*b*. Hereinafter, the production process will be described step by step.

[First Step]

Figure 4A:
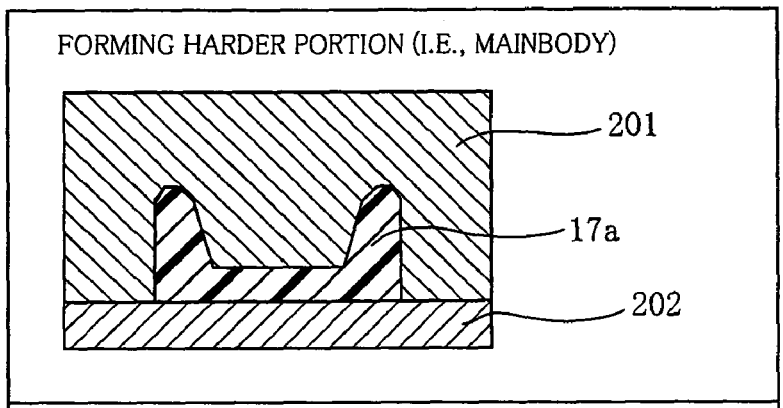

Initially, the mainbody 17*a* is formed by injecting the first material into a space formed between a lower mold 202 as a first mold and an upper mold 201 as a second mold, as shown in FIG. 4A. The upper mold 201 is for forming a harder portion of the protective cap 17, namely, the mainbody 17*a*.

[Second Step]

Figure 4B:
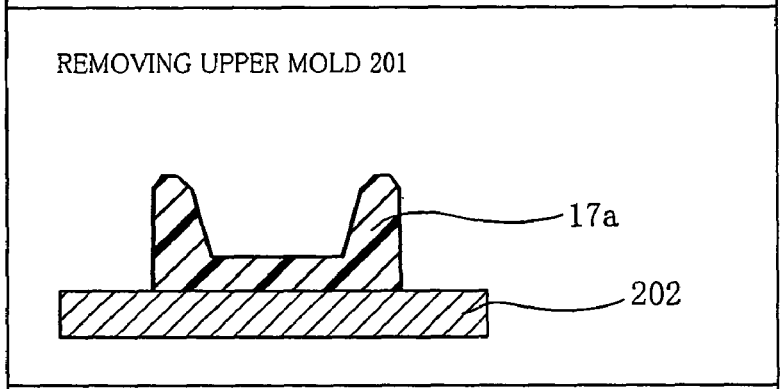
Figure 4C:
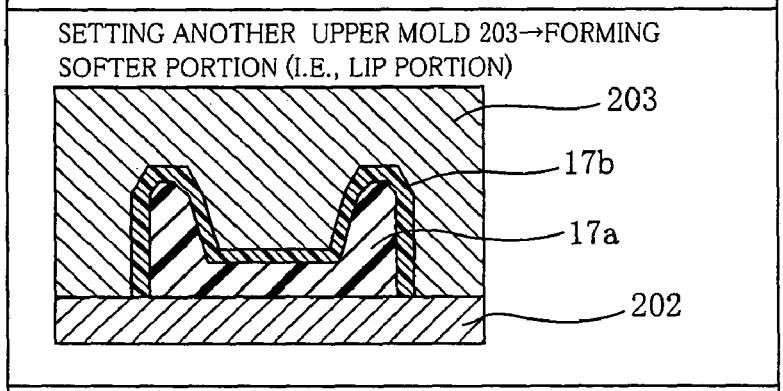
Figure 4D:
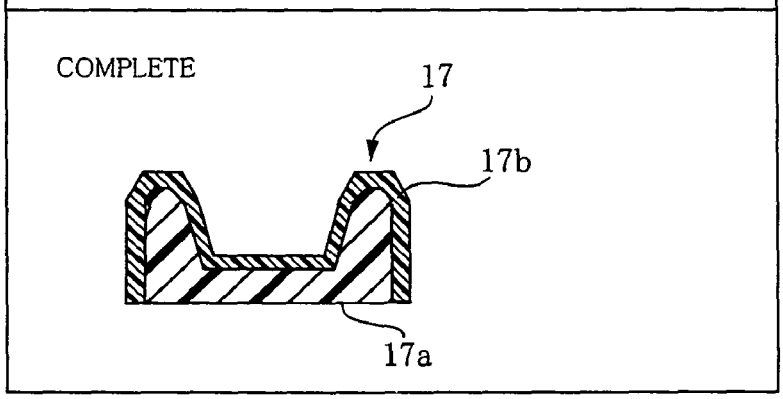

Then, the upper mold 201 is disengaged from the lower mold 202, as shown in FIG. 4B. Thereafter, an upper mold 203 (as a third mold) for forming a softer portion of the protective cap 17, namely, the lip portion 17*b*, is coupled with the lower mold 202. The second material is injected into a space formed between the upper mold 203 and the lower mold 202 to form the lip portion 17*b*, as shown in FIG. 4C. Then, the upper mold 203 is taken off, and the formed protective cap 17 is taken off the lower mold 202. FIG. 4D shows the protective cap 17 as finished.

Effects of the Embodiment (1) According to the protective cap 17 of the above-described embodiment, the mainbody 17*a* is formed of the first material having the first degree of hardness and mainly composed of thermoplastic elastomer and containing butyl rubber. Meanwhile, the lip portion 17*b* disposed on the mainbody 17*a* to cover at least an upper portion of the protruding portion 17*d* (in the embodiment, to cover an entire upper surface and side surfaces of the mainbody) is formed of the second material mainly composed of thermoplastic elastomer and containing butyl rubber, and the second material has the second degree of hardness that is lower than the first degree. Thus, the hardness of the mainbody 17*a* is made higher than that of the lip portion 17*b*, in order to make the protective cap 17 not tend to deform or collapse when a sucking operation is implemented. Further, the lip portion 17*b* having a relatively low hardness, in other words, having an elasticity, can establish a stable and reliable hermeticity between the protective cap 17 and the ejection surface of the recording head 10.

(2) According to the protective cap 17, the first degree of hardness is 60 Hs JIS A or higher and the second degree of hardness is 40 Hs JIS A or lower. This setting is preferable in terms of formation of the protective cap 17.

(3) The mainbody 17*a* and the lip portion 17*b* of the protective cap 17 are formed of respective materials both of which are mainly composed of thermoplastic elastomer and contain butyl rubber, but which differ from each other in hardness. The materials are in order injected into a same lower mold to first form the mainbody 17*a* and then the lip portion 17*b*. Hence, the molecular bond between the mainbody 17*a* and the lip portion 17*b* is strong, making the mainbody 17*a* and the lip portion 17*b* not tend to separate from each other at their interface. Thus, the protective cap is highly robust or unbreakable.

(4) Each of the first and second materials is mainly composed of thermoplastic elastomer and contains at least 20% butyl rubber. Thus, the air permeability of the protective cap 17 is relatively low, thereby enhancing the hermeticity between the protective cap 17 and the ejection surface of the recording head.

(5) In the above-described embodiment, the mainbody 17*a* and the lip portion 17*b* of the protective cap 17 are formed of respective materials which are mainly composed of thermoplastic elastomer and contain butyl rubber, and which differ from each other in hardness and are in order injected into a same lower mold to form the protective cap 17. According to this production method, the first and second steps of respectively forming the mainbody 17*a* and the lip portion 17*b* by injection molding can be implemented by using the same lower mold. This is advantageous in that after formation of the mainbody 17*a*, the lip portion 17*b* can be formed without a step of taking the mainbody 17*a* off the lower mold, and only it is necessary to replace the upper mold with another upper mold. Thus, the protective cap 17 can be produced with a smaller number of production steps and at a lower production cost. Hence, the protective cap 17 in the inkjet recording apparatus 1 is highly robust, and can be produced with a reduced number of production steps and at a lower production cost, with the lip portion 17*b* of the protective cap 17 being prevented from deforming or collapsing during a sucking operation to ensure the hermeticity between the protective cap 17 and the ejection surface of the recording head 10.

Other Embodiments

Although there has been described one embodiment of the invention, it is to be understood that the invention is not limited to the details thereof, but may be otherwise embodied with various changes and modifications, without departing from the scope and spirit of the invention defined in the appended claims. For instance, the invention may be embodied as follows.

(1) According to the above-described embodiment, the mainbody 17*a* of the protective cap 17 is formed of the first material having the first degree of hardness that is 60 Hs JIS A or higher, and the lip portion 17*b* of the protective cap 17 is formed of the second material having the second degree of hardness that is 40 Hs JIS A or lower. However, this is not essential and the hardness of the materials may be set as follows, for instance. (i) The hardness of the first material forming the mainbody 17*a* is set to be 60 Hs JIS A or higher, but the hardness of the second material forming the lip portion 17*b* is set not to be 40 Hs JIS A or lower. (ii) Alternatively, the hardness of the second material forming the lip portion 17*b* is set to be 40 Hs JIS A or lower, but the hardness of the first material forming the mainbody 17*a* is determined not to be 60 Hs JIS A or higher. Although the degree of preferability is lower than the setting of the hardness in the above-described embodiment, each setting (i), (ii) is preferable in terms of formation of the protective cap 17.

Figure 5A:
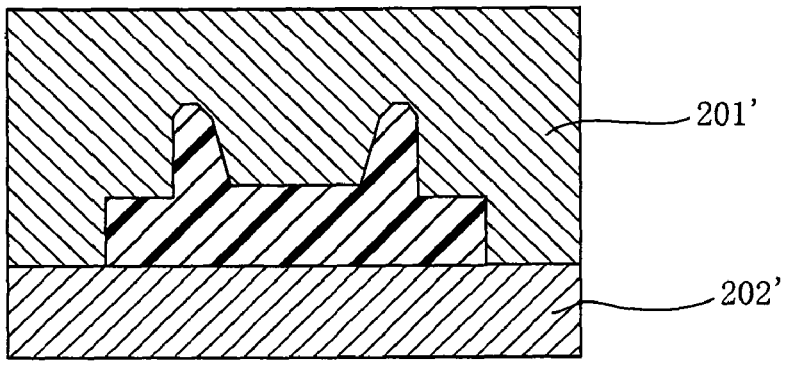
FIGS. 5A-5D illustrate a production process of a protective cap a mainbody of which is integrally formed with a cap holder.
Figure 5B:
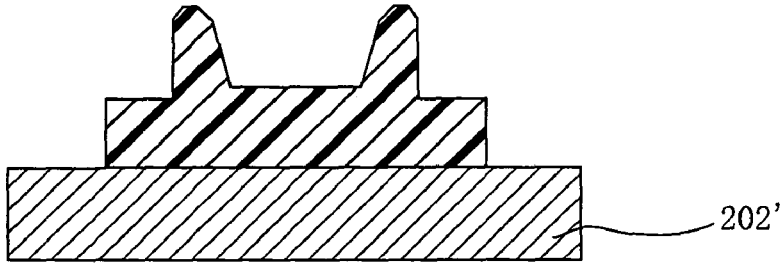
Figure 5C:
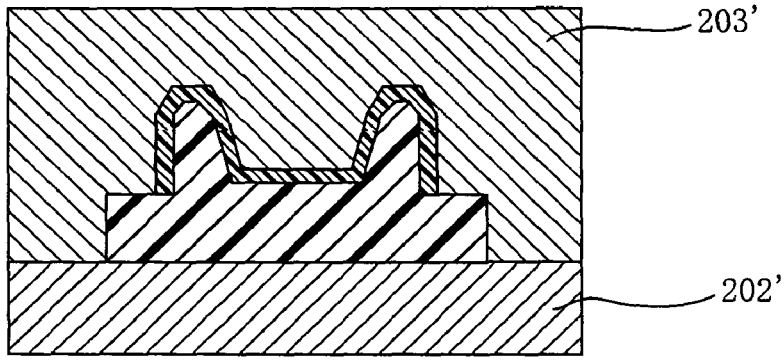
Figure 5D:
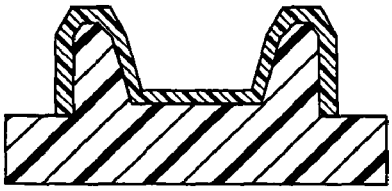

(2) In the above-described embodiment, the protective cap 17 and the cap holder 20 are formed separately from each other, and then assembled. However, it may be adapted such that the cap holder 20 is formed of a material like the first and second materials forming the protective cap 17, namely, a material mainly composed of thermoplastic elastomer and containing butyl rubber, and the cap holder 20 and the protective cap 17 are formed integrally. FIGS. 5A-5D illustrate a production process of such a modified protective cap. A first step is shown in FIG. 5A, where the mainbody and the cap holder are integrally formed by injecting a first material into a space defined between an upper mold 201' and a lower mold. In a second step shown in FIG. 5B, the upper mold 201' is removed. In a third step shown in FIG. 5C, another upper mold 203' is set to define a space between the upper mold 203' and the integrally formed mainbody and the cap holder, and a second material is injected into the space to form the lip portion. FIG. 5D shows an integrally formed protective cap and the cap holder as taken out of the molds 203' and 202'. According to this modification, the protective cap 17 and the cap holder 20 are manufactured with a reduced number of production steps and at a lower production cost. Further, the number of components of the inkjet recording apparatus 1 and the number of steps required to assemble the apparatus 1 can be reduced by the elimination of the step of assembling the protective cap 17 to the cap holder 20.

(3) In the above-described embodiment, the communication nozzles 20*a*-20*d* of the cap holder 20 are connected to the vacuum pump 112 via the tubes 111*a*-111*d*. However, it may be adapted such that a switching device for switching an object to apply the negative pressure of the vacuum pump 112 is interposed between the communication nozzles 20*a*-20*d* of the cap holder 20 and the vacuum pump 112, and one of the communication nozzles 20*a*-20*d* of the cap holder 20 is selected as the object to apply the negative pressure from all the communication nozzles 20*a*-20*d*, whereby one of the nozzle rows 10*a*-10*d* in the recording head 10 from which the ink and bubbles are to be sucked is selected.

What is claimed is:

1. A protective cap for an inkjet recording apparatus including a recording head having an ejection surface in which open ends of a plurality of nozzles are arranged in a row, the protective cap adapted to cover the row of the open ends of the nozzles such that a sealed space is formed inside the protective cap, and comprising:

a mainbody formed of a first material mainly composed of thermoplastic elastomer and containing butyl rubber, the first material having a hardness of a first degree, the mainbody including:

a base portion; and a protruding portion formed integrally with the base portion to protrude from the base portion; and an elastic lip portion formed of a second material mainly composed of thermoplastic elastomer and containing butyl rubber, the second material having a hardness of a second degree which is lower than the first degree, and the lip portion being disposed on both the protruding portion and the base portion to cover both an entirety of the protruding portion and the base portion, wherein the lip portion is configured to contact the ejection surface such that a space defined by the base portion, the protruding portion, and the ejection surface is sealed.

2. The protective cap according to claim 1, wherein each of the first and second materials contains at least 20% butyl rubber.

3. The protective cap according to claim 2, wherein the first degree is a hardness defined by JIS K6301(A type) of 60 or higher.

4. The protective cap according to claim 2, wherein the second degree is a hardness defined by JIS K6301(A type) of 40 or lower.

5. The protective cap according to claim 2, wherein the first degree is a hardness defined by JIS K6301(A type) of 60 or higher, and the second degree is a hardness defined by JIS K6301(A type) of 40 or lower.

6. The protective cap according to claim 1, wherein the first degree is a hardness defined by JIS K6301(A type) of 60 or higher.

7. The protective cap according to claim 1, wherein the second degree is a hardness defined by JIS K6301(A type) of 40 or lower.

8. The protective cap according to claim 1, wherein the first degree is a hardness defined by JIS K6301(A type) of 60 or higher, and the second degree is a hardness defined by JIS K6301(A type) of 40 or lower.

9. The protective cap according to claim 1, wherein the mainbody and the lip portion are fixed to each other by molecular binding.

10. The protective cap according to claim 1, wherein the mainbody is first formed by injection molding, and then the lip portion is formed on the mainbody by injection molding.

11. The protective cap according to claim 1, wherein the mainbody is formed by injecting the first material into a space defined between a first mold and a second mold; and the lip portion is formed by injecting the second material into a space defined between a third mold and the formed mainbody supported by the first mold.

12. An inkjet recording apparatus comprising:

the protective cap according to claim 1; and a cap holder formed integrally with the protective cap to support the protective cap, with a material mainly composed of thermoplastic elastomer and containing butyl rubber.

* * * * *